US005901730A

United States Patent [19]

Tisbo et al.

[11] Patent Number: 5,901,730

[45] Date of Patent: May 11, 1999

[54] STACKABLE HOSE REEL CART

[75] Inventors: Thomas A. Tisbo, Barrington Hills; Stephen P. Whitehead, Elgin; Brian Moon, Sycamore, all of Ill.

[73] Assignee: Suncast Corporation, Batavia, Ill.

[21] Appl. No.: 08/514,361

[22] Filed: Aug. 11, 1995

[51] Int. Cl.[6] ..... B65H 75/34

[52] U.S. Cl. ..... 137/15; 137/315; 137/355.27

[58] Field of Search ..... 137/15, 315, 355.27, 137/355.16, 355.26

[56] References Cited

U.S. PATENT DOCUMENTS

| | | | |
|---|---|---|---|
| Re. 32,510 | 9/1987 | Tisbo et al. | 137/355.27 |
| 4,512,361 | 4/1985 | Tisbo et al. | 137/355.27 |
| 4,777,976 | 10/1988 | Johnston et al. | 137/355.27 |
| 5,046,520 | 9/1991 | Sanchez, Jr. et al. | 137/355.27 |
| 5,425,391 | 6/1995 | Tisbo et al. | 137/355.27 |

*Primary Examiner*—A. Michael Chambers
*Attorney, Agent, or Firm*—McHale & Slavin

[57] ABSTRACT

The instant invention is a hose cart of a shape and design allowing pre-assembly thereby eliminating the need for instructional manuals and associated product packaging necessary of hose carts that are sold in an unassembled state. The hose cart employs a single unitary frame for support of flexible garden hose to be wound in a coil of multiple layers by use of a directional stress relieving hose reel spool. Reel flanges are oblong shaped for holding of the hose within the form spool yet providing nesting ability for assembled carts. A foldable tray and hose feeder is further provided in a industrial type frame designed for commercial type use.

25 Claims, 14 Drawing Sheets

10
17
5
20
18
4
21
12
16
14
31

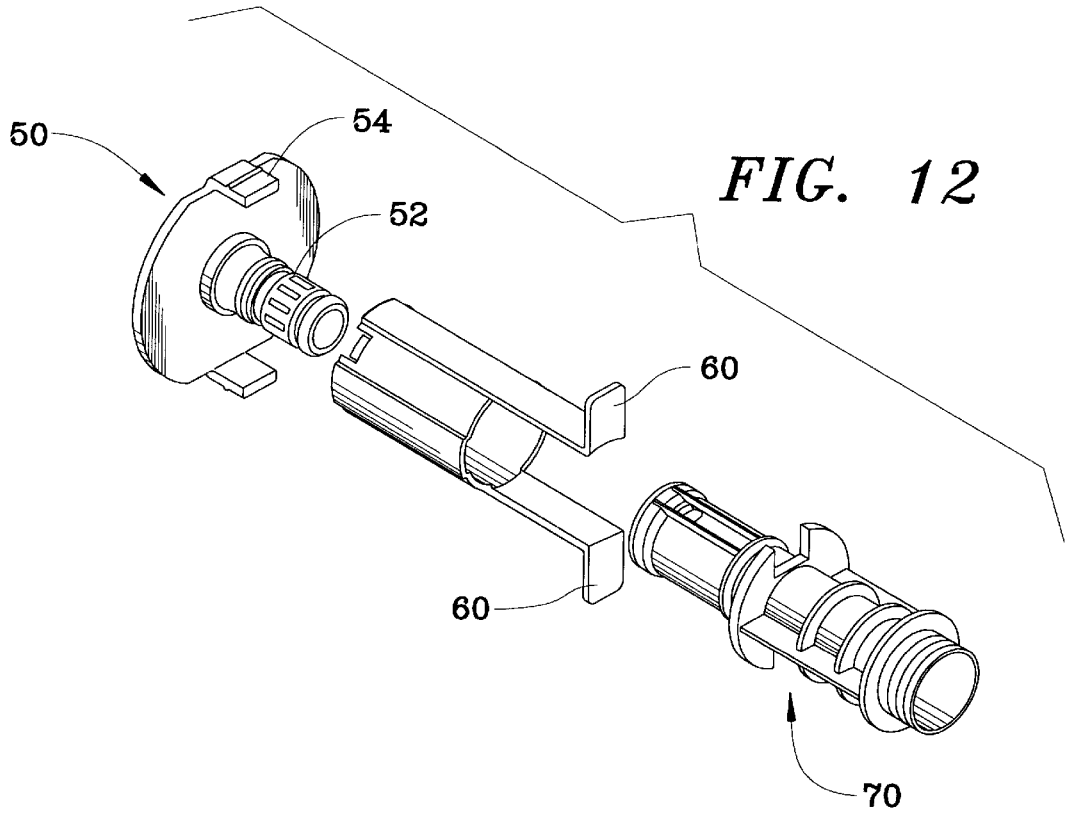
FIG. 12
FIG. 12A
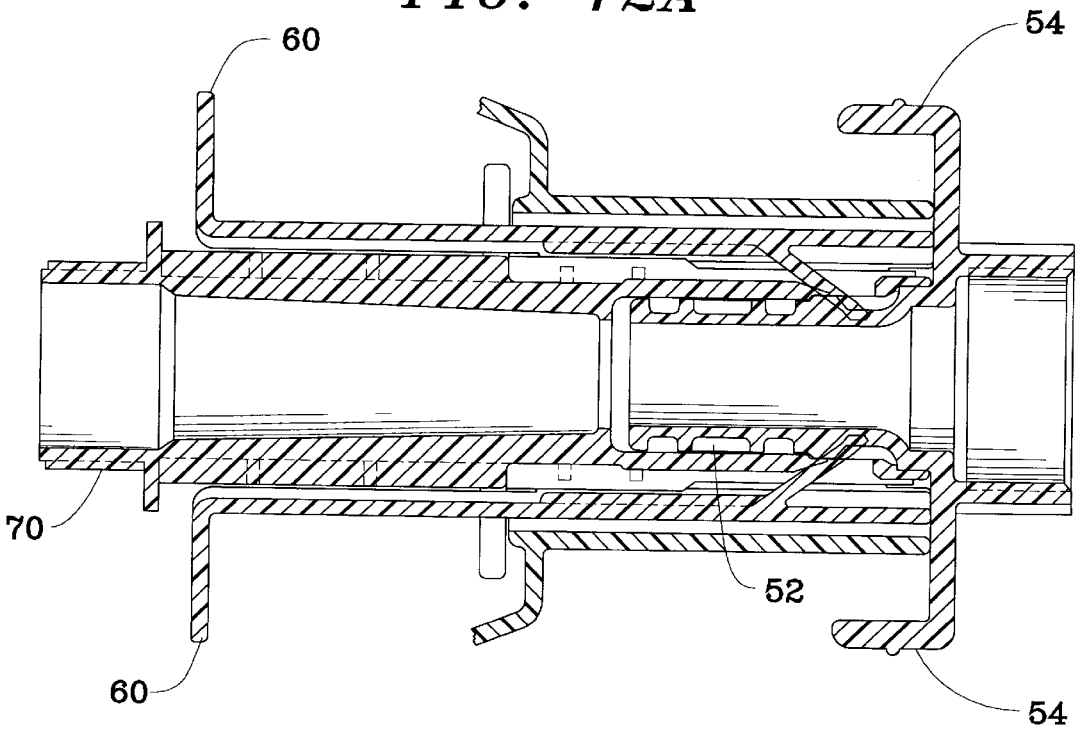

STACKABLE HOSE REEL CART

FIELD OF THE INVENTION

This invention relates to the storage of flexible garden hoses and, more particularly, to an improved portable hose cart that can be preassembled and shipped in a stacked array.

BACKGROUND INFORMATION

Portable hose carts for convenient handling and storage of a flexible garden hose have gained wide public acceptance. Such carts are primarily constructed of molded plastic components having a centrally disposed rotatable spool for reeling inward or outward the flexible hose, a frame including a pair of frame sides for supporting the spool, wheels at one end of the base of the frame, and a handle for tilting the frame onto the wheels so that the cart may be easily moved. For more information concerning the structure and operation of such a hose cart, reference may be made to U.S. Pat. No. RE. 32,510, the teachings of which are hereby incorporated by reference.

Hose carts are commonly purchased by the general consumer wherein it is desirable that the hose cart can be easily assembled with fasteners using minimal hand tools. The use of such fasteners can be time consuming and requires the use of hand tools. Commercially available hose carts typically make extensive use of threaded fasteners to join major components.

U.S. Pat. No. 4,913,580 teaches the use of a connector assembly for joining components of a hose cart. A male component of the assembly is molded with one piece of the cart, and a female component of the assembly is molded with a second piece of the cart to be joined to the first piece. These components are easily unlatched to permit disassembly of the hose cart.

A problem with portable hose carts of the prior art is that, despite the directions for assembly, a majority of the consuming public are unable or have no desire to assemble such devices. Cottage industries have developed solely for the purpose of assembling products that have been purchased in a disassembled state. Many stores that inventory unassembled product have personnel or staff capable of assembling the product for the customer. If the store performs this assembly at no charge to the customer, it is a burden on the store. Alternatively, the store may assemble the product and pass the cost onto the consumer.

One of the problems with any assembly outside of the factory is that improper assembly can damage the product. This typically occurs when the assembler does not read the instructions or tries to force fit a component. The result is aggravation for the purchaser, who may then ask the store to take back the product and refund their money. Obtaining a refund is a time consuming and expensive process to both the store and the producing factory. The store may return the product to the factory who then attempts to salvage the damaged product. Not unexpectedly, most returned items are damaged as a result of improper assembly.

Most large products produced by a manufacturer are not assembled due to the size of the packaging required once an assembled product is put into an operating form. For instance, a typical hose cart is shipped in a disassembled state so that it can fit in a box that allows the device to be shipped on a pallet together with numerous other boxes. Under such circumstances it is not unusual to have ten or more boxes of portable hose reels placed on a pallet wherein a forklift can be used for lifting of the pallet for placement.

A receiving store may leave a shipment of boxed hose carts on a shipping pallet above the normal reach of the consuming public. Boxed product is brought down to replenish those items purchased, thereby forcing the store to decide whether or not to assemble the product before display.

Unassembled hose carts are packaged in a shipping carton to protect the product during shipping and storage, and more importantly, prevent loss of individual components before assembly. A great deal of time and expense goes into packaging of the product so as to maximize packaging compactness. The shipping carton must include indicia to indicate to the public what the contents of the carton are. Adding an expense to the carton is the use of color graphics which is preferred by store owners so that potential purchasers do not break open the cartons in an effort to determine the contents of the carton. The unassembled hose carts further require the inclusion of assembly instructions.

Disposal of shipping containers is also wasteful. Once a hose cart is assembled, the shipping carton is unusable for nearly any other purpose. The carton becomes a waste product that will hopefully be recycled but realistically adds mass to a landfill. U.S. Pat. No. 4,512,361; U.S. Pat. No. 5,046,520 and U.S. Pat. No. 5,056,553 all set forth hose cart storage apparatuses which consist of various preassembled components that are easily assembled upon receipt by the average consumer. Common among these devices is the need for shipping cartons so that the components are not lost in transit. Thus, despite the simplicity of the assembly, all such devices are dependent upon the use of properly sized shipping cartons which further require graphics so that the consumer can determine the contents of the carton.

Another problem with the prior art hose cart device is the securement of a reel hub necessary for the introduction of water. The reel hub must allow rotation yet allow the device to be hooked up to a water supply wherein the hose can be reeled inward or outward without interfering with the flow of water. Seals within the hub allow rotation without leakage. The problem occurs when the seals require service, either in the form of lubrication or replacement. This is a common problem in the northern states where the device may be allowed to freeze. As exemplified by the '361 and '520 patents, the hub is coupled to the reel by the use of fasteners such as a metal screw. When the seals require service, the hub must be removed to facilitate replacement. Without proper tools, the unit will be damaged. Should the attachment screws be displaced, the use of improperly sized substitutes may cause the screw threads to strip, damaging the unit. The necessity of tools may dissuade the average consumer from performing even routine maintenance such as lubrication, leading to early failure of the seals.

Another problem with the prior art is that the winding reels do not accommodate the natural curvature of a hose connection which may lead to a premature failure of the hose. To compensate for the curvature, prior art devices employ an extension pipe to direct the water supply to a position external the hub surface. Without such piping, should a flexible hose be wrapped around the reel, the hose is forced into a position placing the hose in a stressed or kinked position.

Thus, what is lacking in the art is a portable hose cart that can be preassembled at the factory, shipped without the necessity of a conventional shipping container, and of such design that the carts can be nested together to reduce storage space. Further, a portable hose cart is needed having an improved reel assembly that can be disassembled without tools and includes a means for reducing stress from a hose wrapped around the reel.

SUMMARY OF THE INVENTION

Among the several aspects and features of the present invention may be noted the provision of an improved portable garden hose cart. The hose cart of the present invention is of a shape and design so that the hose cart may be preassembled at the factory thereby eliminating the need for instruction manuals and associated product packaging. The teaching of the instant invention allows for a plurality of preassembled portable hose carts to be placed upon a skid decreasing the amount of space necessary for storage and transportation thereby increasing the number of units that can be shipped per a given cubic volume of space. In order to accomplish efficiency in shipping and the elimination of shipping cartons, the instant invention incorporates the use of foldable handles, an oblong shaped reel flange, and a one-piece inverted V-shaped frame so as to permit nesting of multiple units.

Preassembling of the hose reel cart of the instant invention permits the use of a single unitary frame construction for support of a flexible garden hose to be wound into a coil of multiple layers with adjacent turns of each layer touching each other by use of a directional reel forming a spool rotatably coupled to the frame. Reel flanges forming the side walls of the spool are oblong shaped for holding of the hose within the spindle of the reel in a similar manner as the prior art, yet allowing for the aforementioned nesting of assembled hose carts.

The surface of the reel used for winding of the hose includes a provision for coupling to an end of the hose in such a manner as to reduce or eliminate stress normally placed on the flexible hose eliminating the need for a water extension pipe. The reel surface has a ramped directional cavity allowing for placement of a hose further adding a directional aspect for the hose. The cavity allows winding of a hose in a clockwise or counter clockwise direction. The flexible hose is wound around the reel by use of a hand crank coupled through a hub providing a direct rotational link between the crank and the winding of the spool. During non-use a handle on the crank is placed in a storage position by pivoting the handle about one end of the crank so as to place the handle in a position perpendicular to the crank. The crank can be positioned on either side of the frame providing a left or right handed operation. Despite the unit being preassembled by the factory, this interchangeable feature allows a water connector to be easily removed from the hub by depressing a syringe type pulling mechanism surrounding the connector to release tabs biased on the inside of the hub. The quick release water connector provides ease of access to internal sealing O-rings should they need maintenance.

Thus, a primary objective of the instant invention is to provide a portable hose cart having a one piece frame with all components preassembled so as to eliminate the need for packaging and instruction manuals commonly used in the prior art.

Yet another objective of the instant invention is to provide a portable hose cart that can be stacked on top of similar hose carts in a nesting fashion teaching the ability to ship more units per cubic foot volume than possible with the prior art if packaged individually even in a completely disassembled state.

Another objective of the instant invention is to disclose the use of quick release locking tabs that allow the crank of a winding spool to be placed on either side of the frame permitting left or right handed operation.

Yet another objective of the instant invention is to provide a functional cross support in the handle allowing a reduction in the mass of the handle and further providing a means for holding the free end of a flexible hose in an upright position so as to prevent water dripping during storage.

Yet still another objective of the instant invention is to provide a water connector that can be installed and removed without the use of hand tools. In particular, the connector will use a syringe type attachment mechanism that engages tabs on the inner surface of the hub to be disengaged for access to replaceable O-rings.

Still another objective of the invention is to teach the use of a handle locking mechanism that eliminates the need for a hook pin and can be incorporated into the frame of a portable hose cart wherein it can be positioned so as not to cause accidental release.

Yet another objective of the invention is to provide a foldable tray which pivotally attaches to the folding handle wherein the outer end of the tray includes a rail bar for attaching a sliding hose guide apparatus with an handle and a hose aperture, to assist in properly coiling the hose on the reel assembly.

Other objects and advantages of this invention will become apparent from the following description taken in conjunction with the accompanying drawings wherein are set forth, by way of illustration and example, certain embodiments of this invention. The drawings constitute a part of the specification and include exemplary embodiments of the present invention and illustrate various objectives and features thereof.

DESCRIPTION OF THE DRAWINGS

FIG. 12 is an exploded pictorial view of the hose hub connector as used in the assembled hose reel device;

FIG. 12A is a cross-sectional view of the hose hub connector as used in the assembled hose reel device;

DETAILED DESCRIPTION OF THE PREFERRED EMBODIMENT

Figure 1:
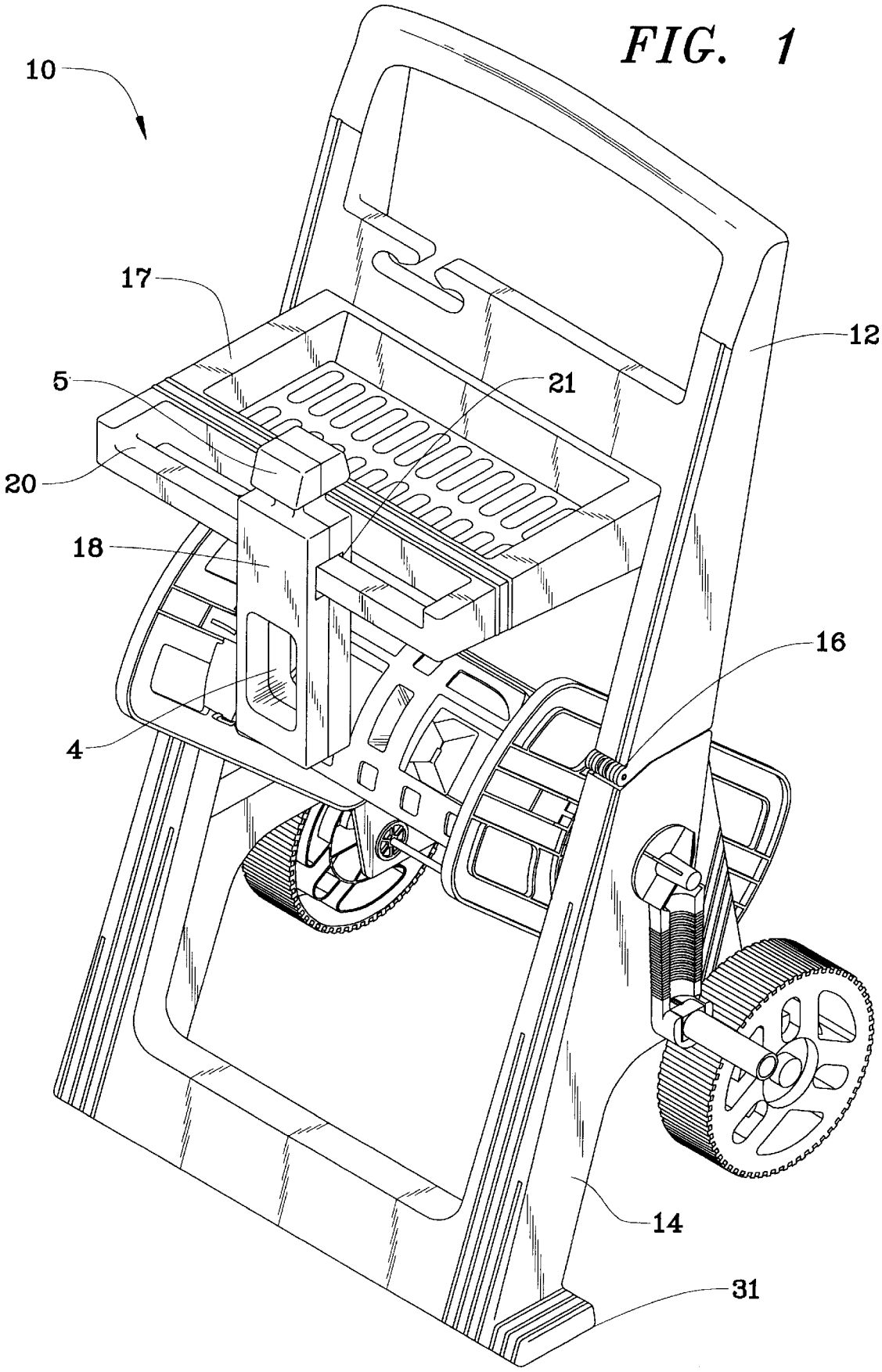
FIG. 1 is a pictorial view of the complete hose reel device with the foldable handle extended upwards and locked into place and the tray folded down and locked into place and the hose guide slidably attached to the tray.
Figure 3:
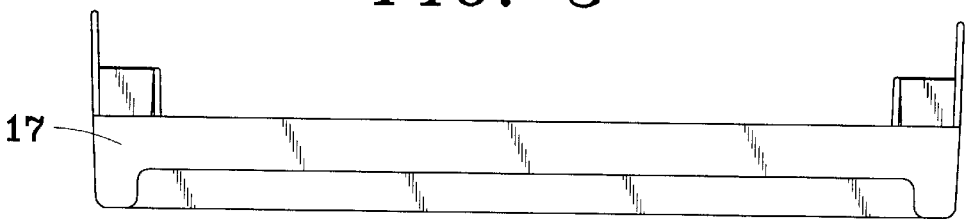
FIG. 3 is an upright frontal view of the foldable tray.
Figure 2:
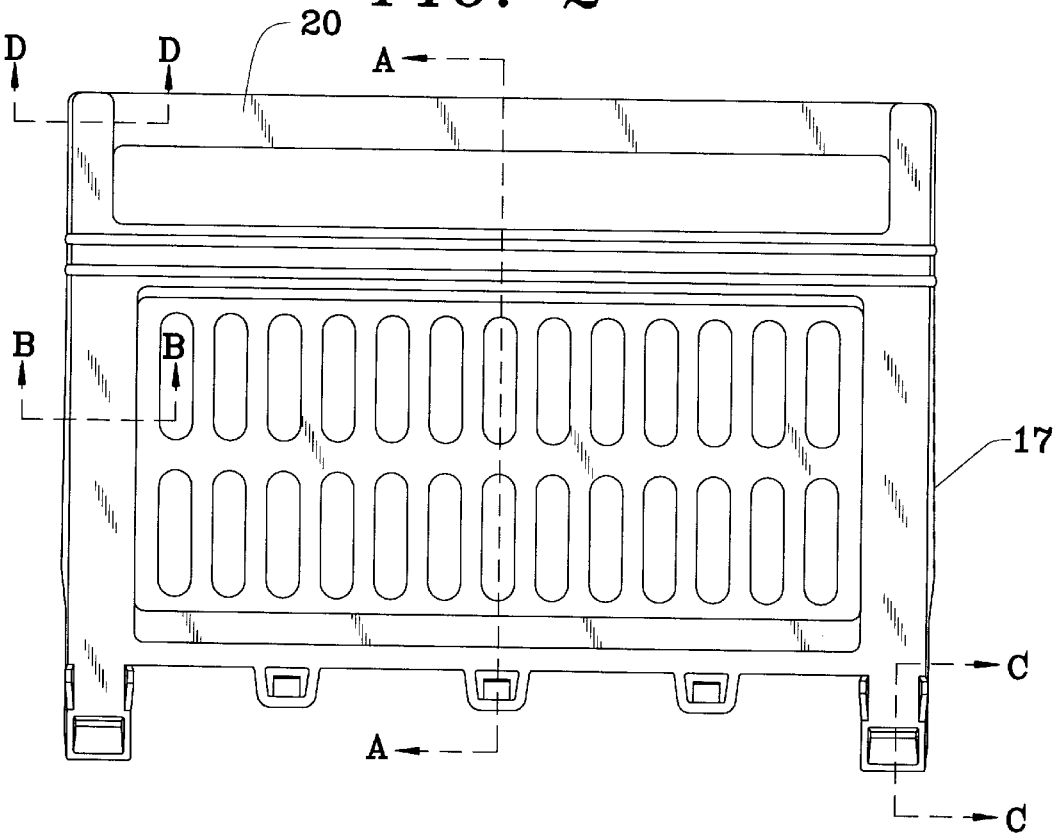
FIG. 2 is a bottom view of the foldable tray.
Figure 4:
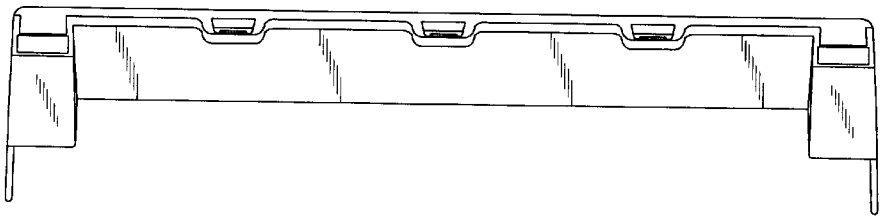
FIG. 4 is an inverted rear view of the foldable tray.
Figure 2A:
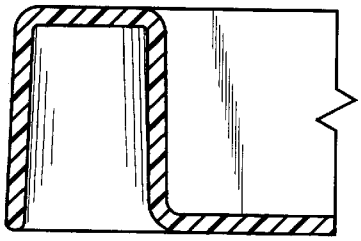
FIG. 2*a* is a cross-sectional portion of FIG. 2 along cut B—B.
Figure 2B:
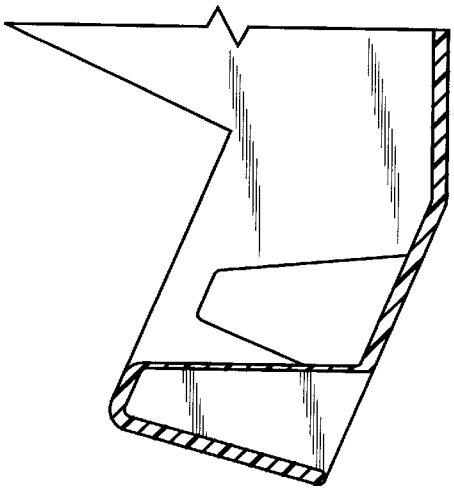
FIG. 2*b* is a cross-sectional portion of FIG. 2 along cut C—C.
Figure 2C:
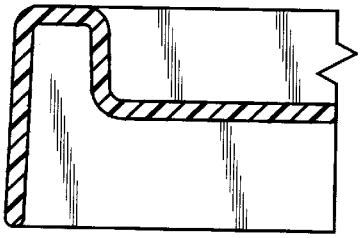
FIG. 2*c* is a cross-sectional portion of FIG. 2 along cut D—D.
Figure 2D:
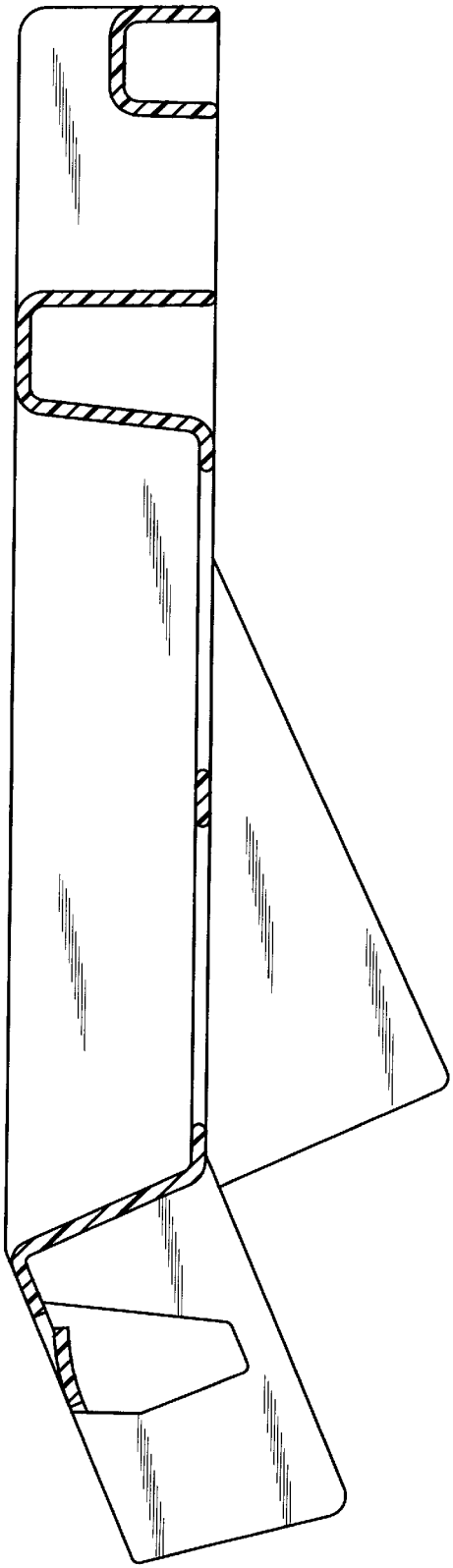
FIG. 2*d* is a cross-sectional view of FIG. 2 along cut A—A.
Figure 5:
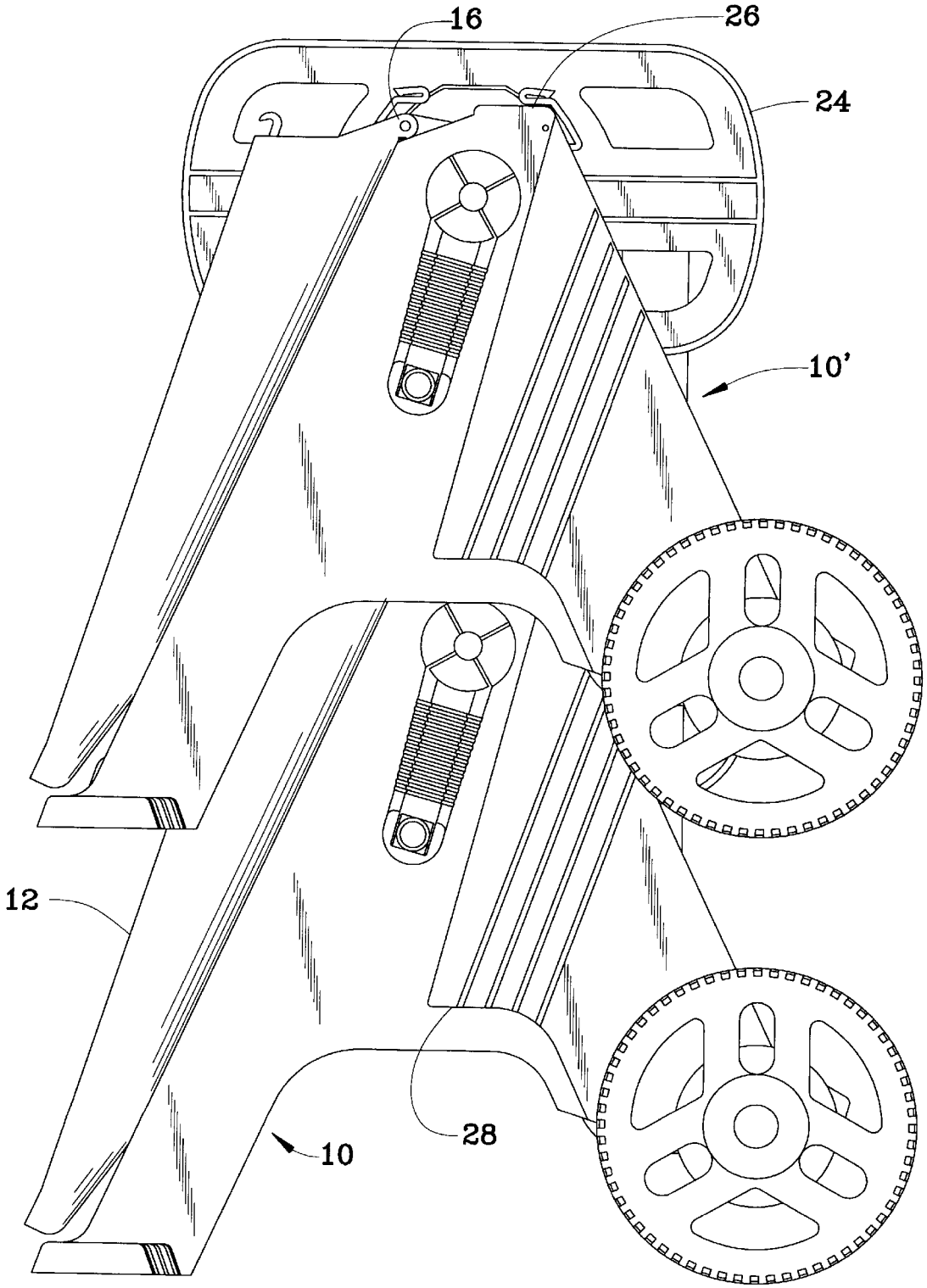
FIG. 5 is a pictorial view of two hose reel devices placed in a stacked position with the handle and hose guide placed in a folded position.
Figure 10:
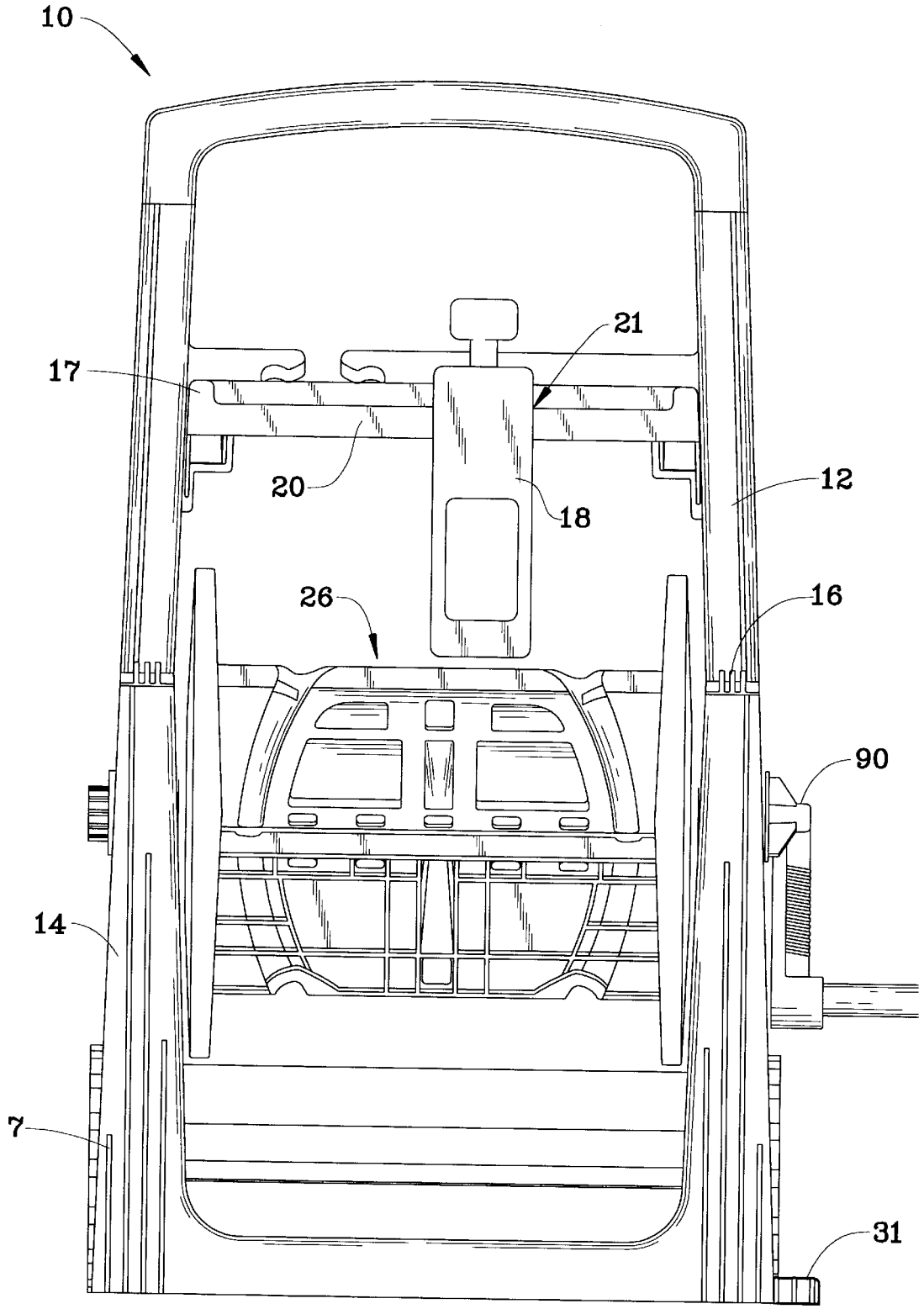
FIG. 10 is a front view of the complete hose reel device with the foldable handle extended upwards and locked into place and the tray folded down and locked into place and the hose guide slidably attached to the tray.
Figure 11:
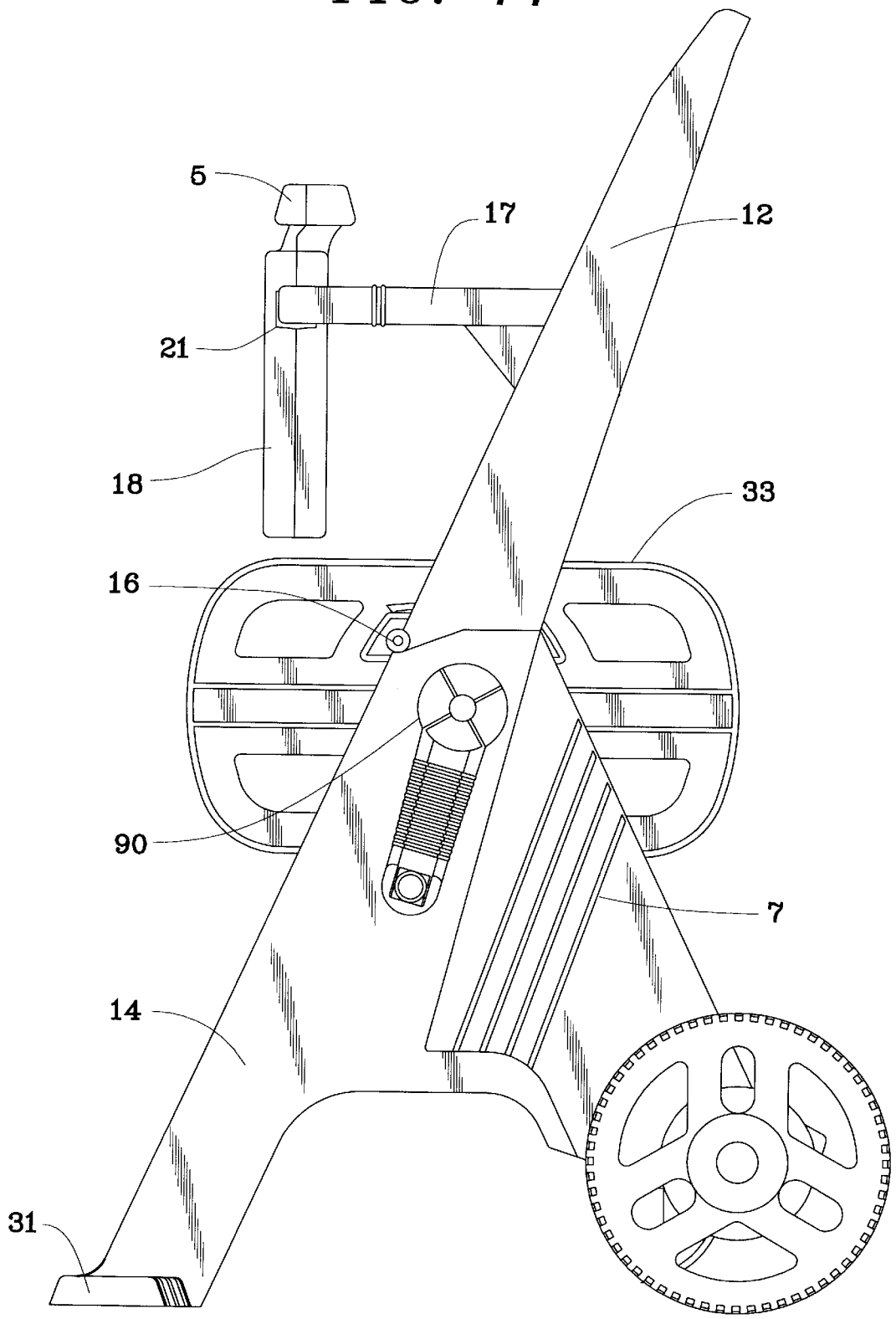
FIG. 11 is a side view of the complete hose reel device with the foldable handle extended upwards and locked into place and the tray folded down and locked into place and the hose guide slidably attached to the tray.
Figure 13:
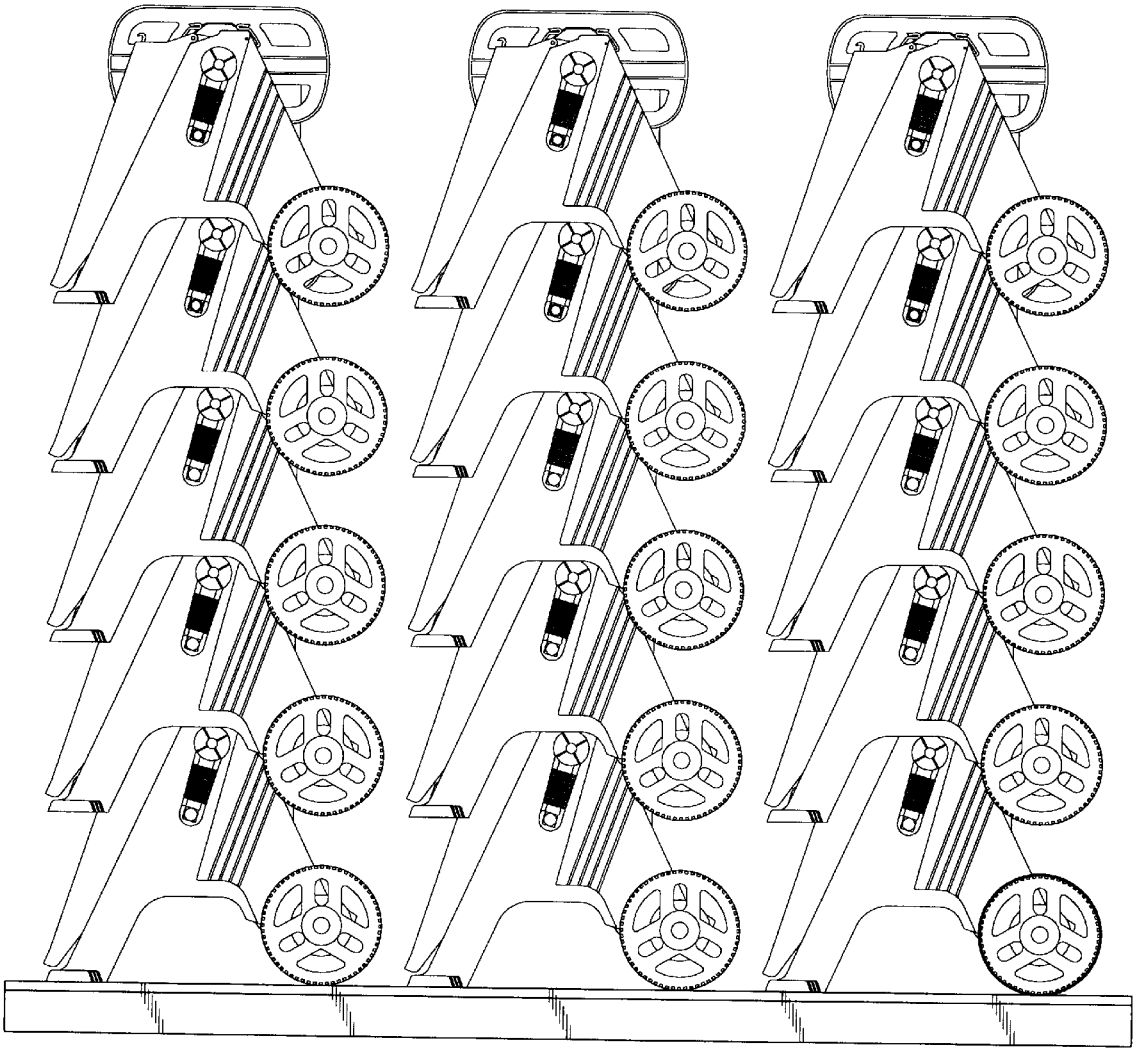
FIG. 13 is a pictorial side view of a plurality of hose carts of FIG. 1, shown with the handle folded down and stacked in a nesting arrangement on a pallet.

Now referring to the drawings in general, in particular FIGS. 1, 10, and 11, set forth is the hose reel cart 10 of the instant invention having foldable handle 12 secured to frame 14 along pivot point 16. The hose reel cart includes a support tray 17 having provisions for the hose guide 18 which slides along railing 20 using an alignment bracket 21 to assist in reeling the hose onto the hose reel. The guide 18 also includes a handle 5 for grasping the guide and sliding it back and forth along the rail 20. A hose aperture 4 in the guide 18 receives the hose and guides the hose onto the reel as the reel is rotated. As shown in FIGS. 5 and 13 device 10 is depicted with handle 12 in a stored position by rotation around hinge 16. Support shelf 17, not shown, is placed in a lowered position with hose guide 18 lowered so as to allow placement of a second unit 10' on top of the first unit. The stacking is allowed by use of oblong reel flange 24 and is secured in position by surface 26 which engages tab 28 of an adjoining hose reel.

Figure 7:
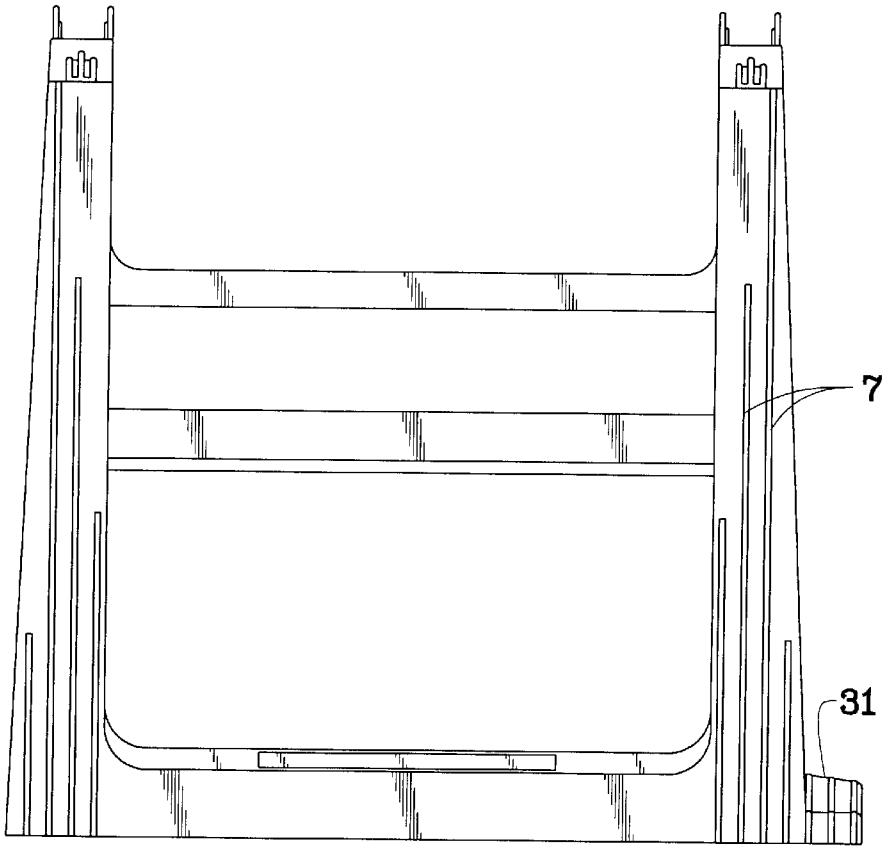
FIG. 7 is a front view of the frame.
Figure 6:
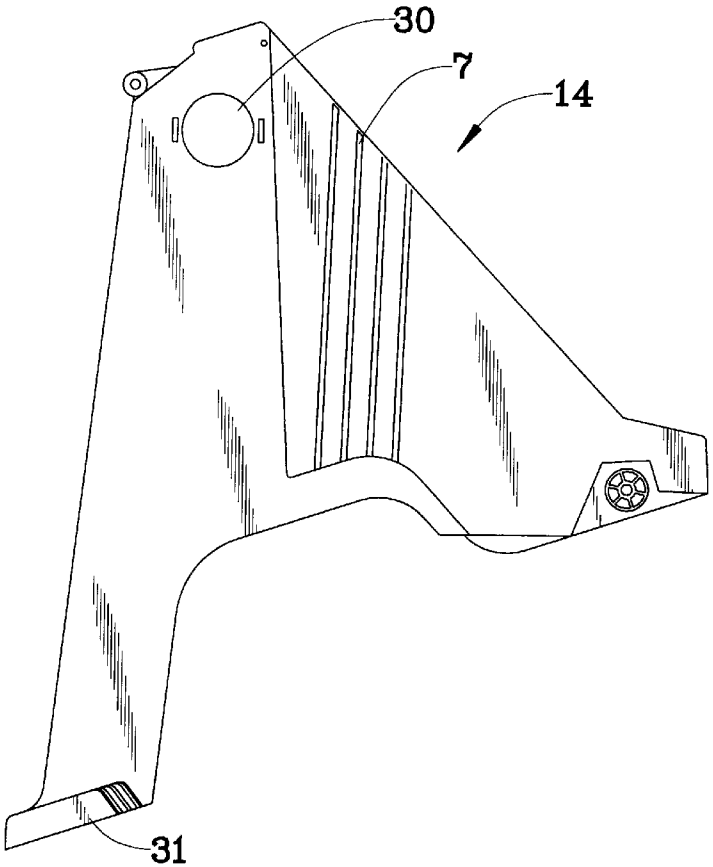
FIG. 6 is a side view of the frame.
Figure 8:
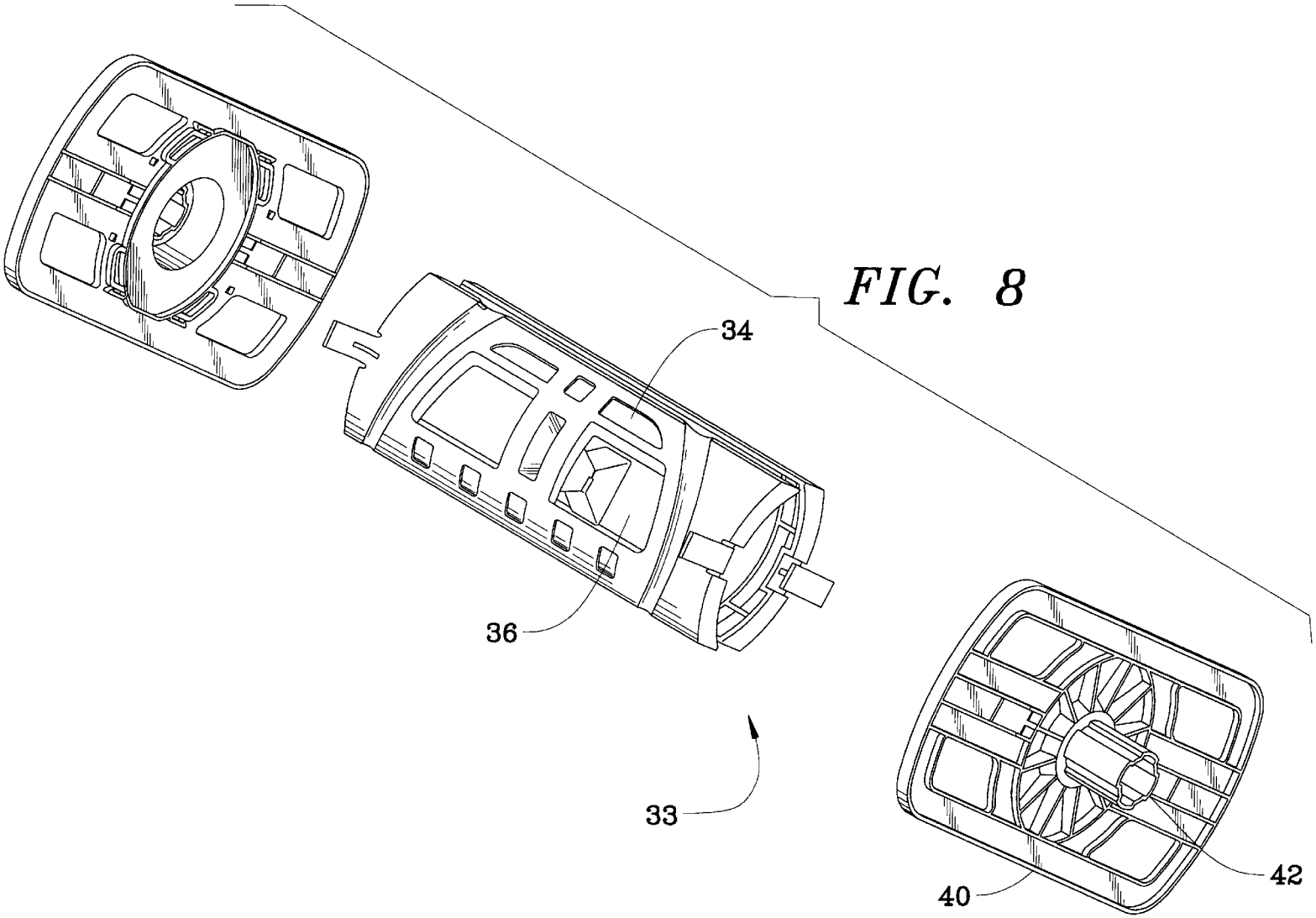
FIG. 8 is an exploded view of the hose reel assembly including the inner reel parts and the outer reel flanges.
Figure 8A:
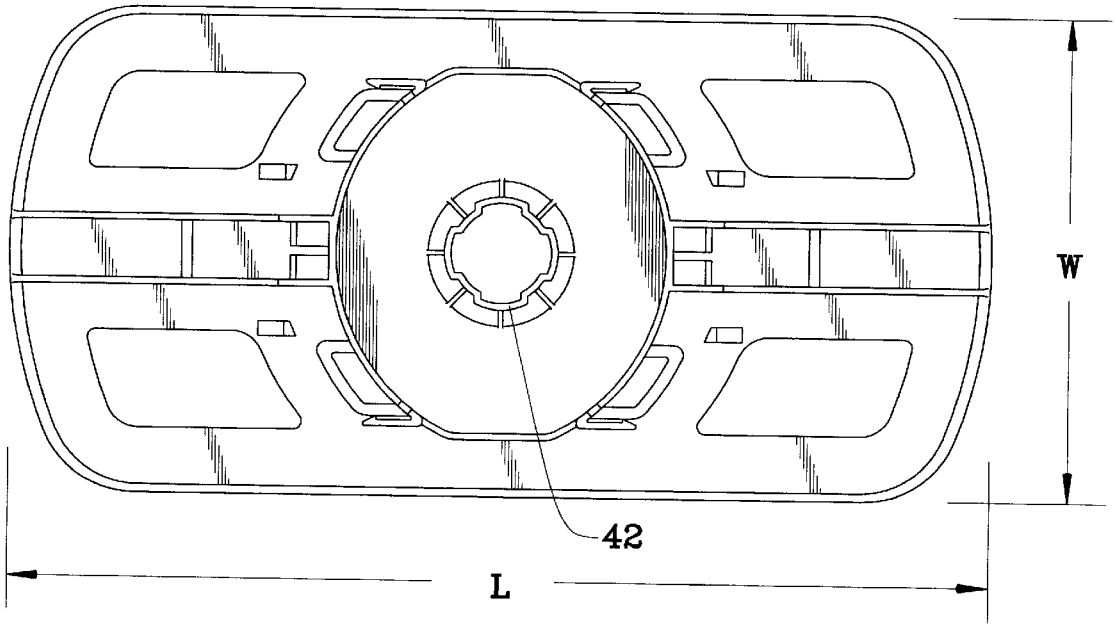
FIG. 8A is a front side view of the reel flange.
Figure 8B:
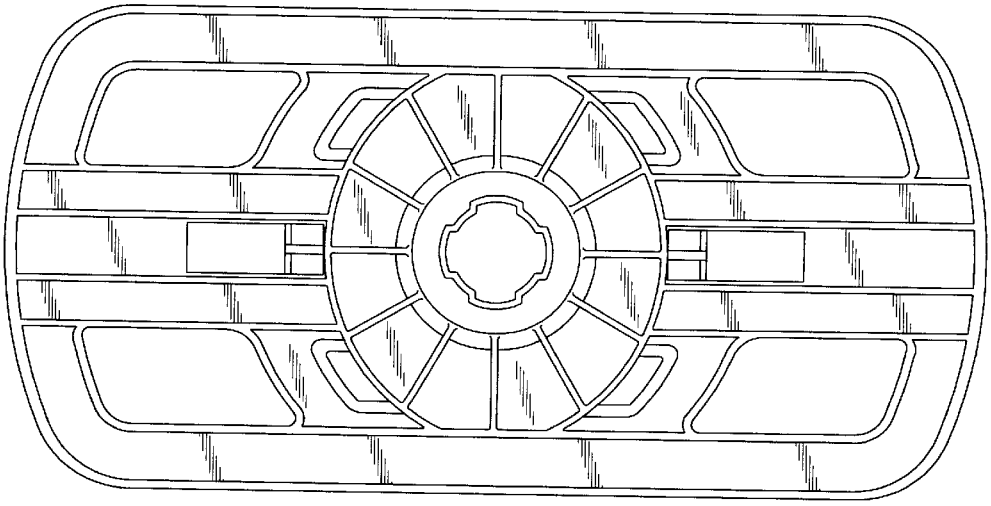
FIG. 8B is a rear side view of the reel flange shown in FIG. 8A.
Figure 9B:
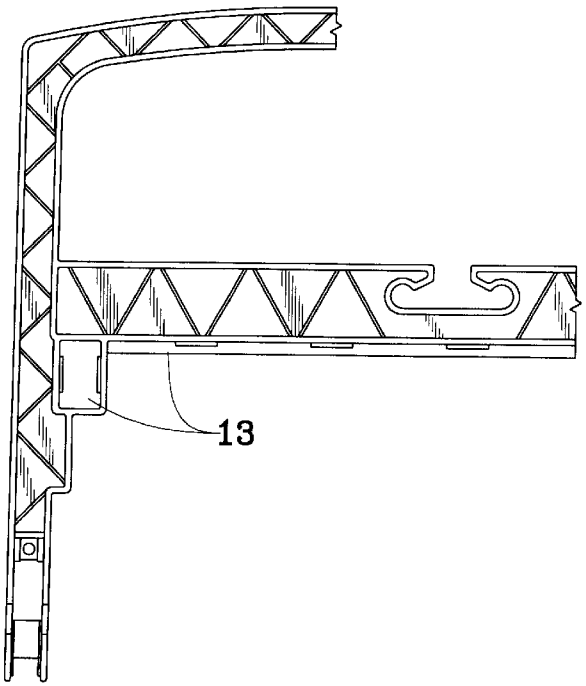
FIG. 9B is a rear view of a portion of the folding handle of FIG. 9.
Figure 9A:
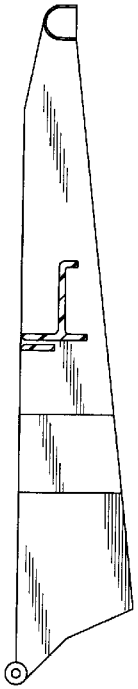
FIG. 9A is a cross-sectional view of the folding handle of FIG. 9 showing the cross-brace.
Figure 9:
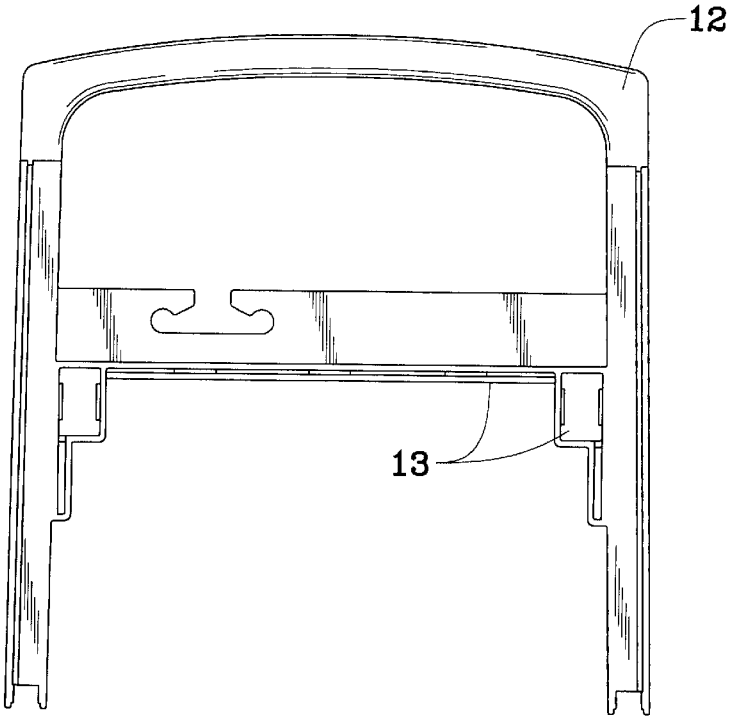
FIG. 9 is a front view of the folding handle.
Figure 14:
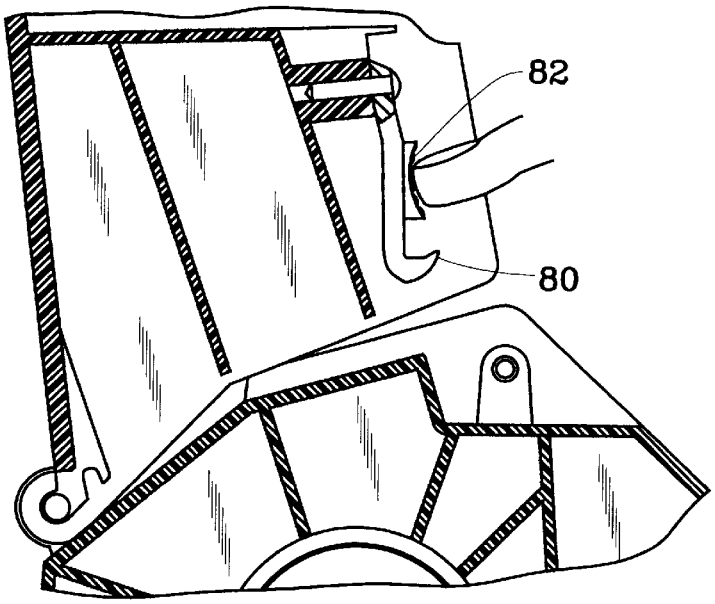
FIG. 14 is an enlarged fragmentary cross sectional view showing a portion of the handle and frame with a lock for securing the handle to the frame, but showing the lock in a released attitude with the handle in a partially pivoted position.
Figure 15:
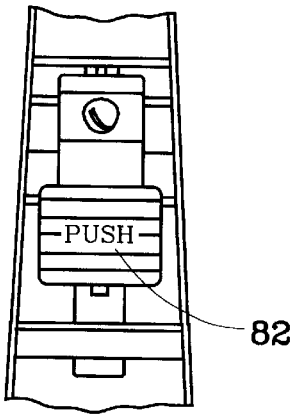
FIG. 15 is an enlarged front view of the lock.
Figure 16:
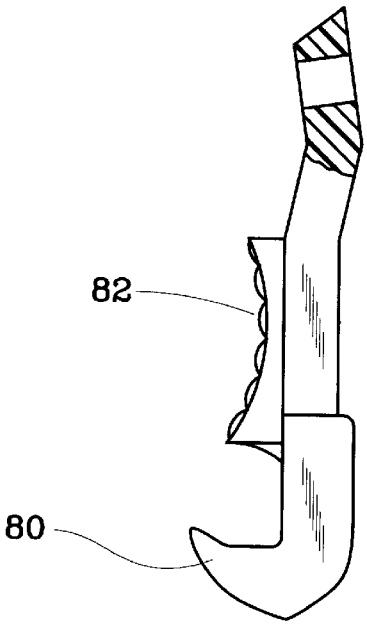
FIG. 16 is a side view of the latch for locking the foldable handle into place.
Figure 17:
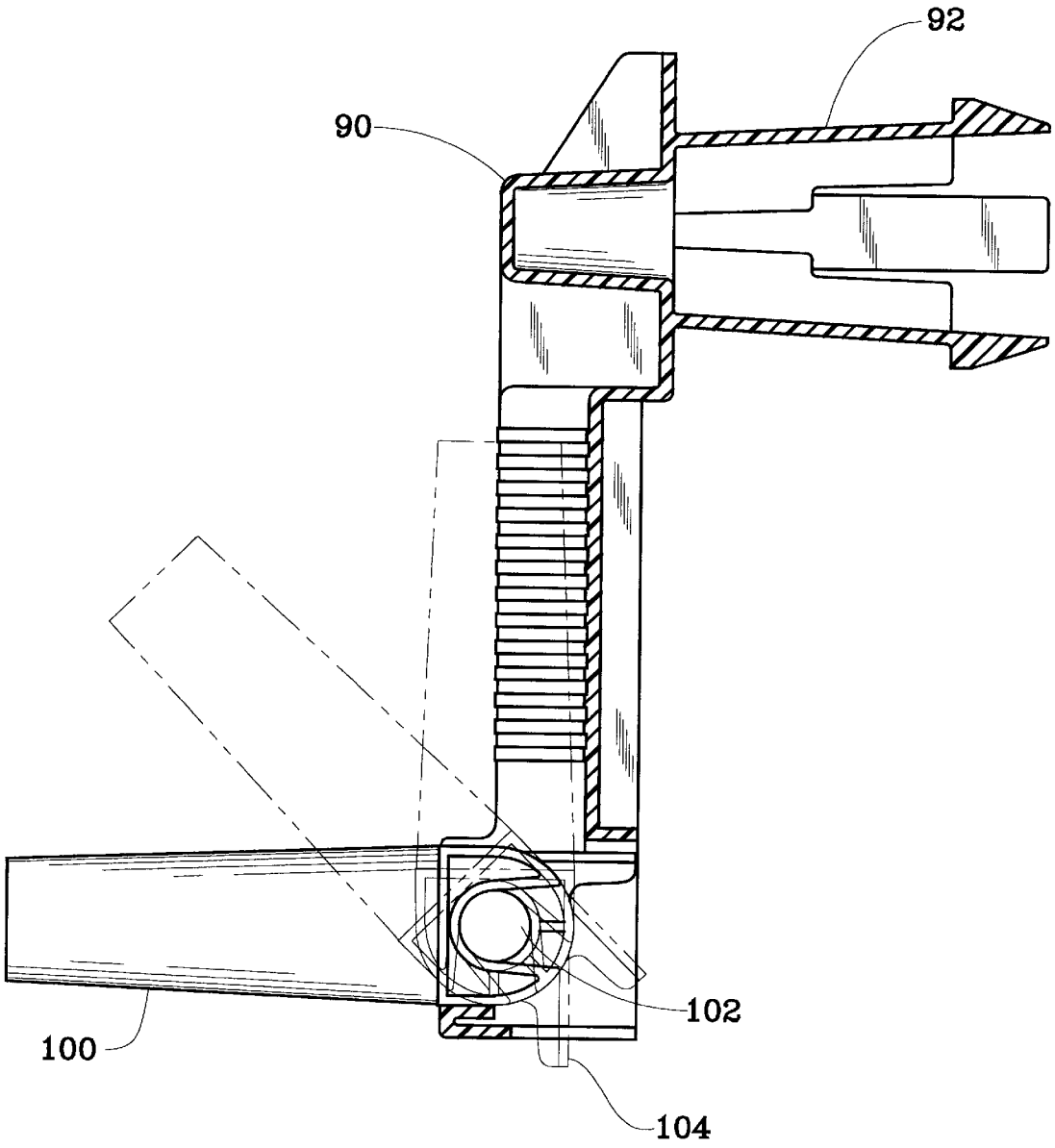
FIG. 17 is an enlarged side view of the reel crank.
Figure 17A:
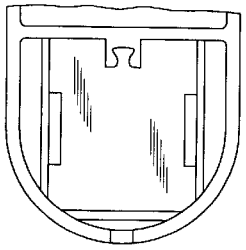
FIG. 17A is an end view of the crank handle socket of FIG. 17.

Referring now to FIGS. 6 and 7, the frame 14 includes a mounting hub 30 which allows for attachment of the reel flange as described later in this invention. Also shown is a foot rest 31 on the frame 14 which can used to hold the hose reel device in place during use. Ribs 7 are shown which interact with each unit frame as they are stacked upon one another. Referring now to FIGS. 8, 8A, and 8B, the reel 33 includes provisions for placement of a hose along chamber 34 with openings 36 for accessing an inner portion of the reel. The reel assembly is described in further detail in this inventor's U.S. Pat. No. 5,425,391. Referring now to FIGS. 14–16, handle 12 has a latch mechanism so as to engage the frame when the handle is placed in an upright position which secures the handle. Referring also to FIGS. 9, 9A, and 9B, the handle 12 is shown with its front, side, and rear views. The pivoting tray mounts 13 interface with the corresponding mounting elements of tray 17. The folding handle assembly and locking mechanism is described in further detail in the this inventor's U.S. Pat. No. 5,425,391. Referring again to FIGS. 8, 8A, and 8B, the reel flange 40 is oblong shaped having a center coupling hole 42 which allows placement of a water coupler or crank handle. Referring now to FIGS. 12 and 12A, the water coupler 50 includes seals 52 to prevent passage of water and is secured in place by tabs 54 allowing ease of replacement. By use of syringe coupling 60 the tabs may be pulled to quickly release the coupler so as to access the O-rings. A second part of the syringe coupling is provided by water coupler 70 which is operatively associated with coupling mechanism 50. The coupling assembly is described in further detail in this inventor's U.S. Pat. No. 5,425,391. Referring again to FIGS. 14–16, the aforementioned latch mechanism for the handle is depicted by latching hook 80 which is released from its engagement by pressing on the forward section 82 so as to move the hook backward to disengage its locking attachment. Referring now to FIGS. 17 and 17A, the reel handle 90 includes outwardly extending insertion tab 92 which allows placement of the handle into either side of the hose reel flange for proper securement. Handle crank 100 is attached to one end of the crank 90 and pivot along aperture 102 with locking tab 104 for placing the crank in a fixed position. The crank handle assembly is described in further detail in this inventor's U.S. Pat. No. 5,425,391.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A method of storing hose storage apparatus for windably holding an elongated flexible garden hose, said method comprising:

molding a single piece support frame having two inverted V-shaped frame sides each, each said frame side having a top surface and split legs depending therefrom forming a front leg and a rear leg, said frame sides formed integral with a front cross bar supporting said front legs and a rear cross bar supporting said rear legs, each said frame side having a hub bearing surface disposed between said top surface and said split legs, said frame also including a foot rest to assist in holding the device in place during operation;

securing a handle having a first leg pivotally connected to said top surface of one said frame side and a second leg pivotally connected to said top surface of said second frame side, said handle storable juxtaposition to said frame side;

attaching to said handle a foldable storage tray which is hingably attached to a bracket mounted to said handle sides, said tray further including a railing for slidably attaching a hose guide, said hose guide including an alignment bracket for encompassing said railing, a guide handle for grasping said guide, and an aperture for receiving the hose;

attaching a spool disposed between said frame sides, said spool having a plurality of cross-braces defining a reel surface for receipt of a flexible hose, said reel surface coupled between a first and second oblong shaped reel flange having a length and a width with said length greater than said width, each said reel flange having a centrally disposed hub operatively associated with each said frame side;

inserting a hose connector comprising a hose male connector being adaptable for connection to a flexible hose available for winding about said spool, a hose female connector being adaptable for connection to an inlet hose, and a coupling sleeve, said hose male connector having at least one O-ring contacting said hose female connector to form a seal therebetween, said hose connector releasably insertable through one of said hubs providing an inlet connection mounted in a fixed position on one side of a reel flange fluidly communicated to an outlet adapter on a second side of said flange;

joining a crank releasably insertable through one of said hubs providing a direct coupling to said spool allowing rotation thereof, said crank including a handle pivotally attached to said crank being positionable from a perpendicular position for hand operation to a raised position to facilitate storage;

placing a pair of wheels journaled to each rear leg; and stacking the assembled hose cart on top of similarly assembled hose carts whereby said crank and said reel flanges are rotated allowing a lower portion of said frame sides to reside against an upper portion of similar shaped frame sides.

2. A stackable hose storage apparatus for windably holding an elongated flexible garden hose comprising:

a single piece support frame defined by two frame sides each having a top surface and split legs depending therefrom forming a front leg and a rear leg, said frame sides formed integral with a front cross bar supporting said front legs and a rear cross bar supporting said rear legs, each said frame side having a hub bearing surface disposed between said top surface and said split legs, said frame also including a foot rest to assist in holding the device in place during operation;

a spool disposed between said frame sides, said spool having a plurality of cross-braces defining a reel surface for receipt of a flexible hose, said reel surface coupled between a first and second oblong shaped reel flange defined by a length and a width with said length greater than said width, each said reel flange having a centrally disposed hub operatively associated with each said frame side hub bearing surface;

a hose connector releasably insertable through one of said hubs providing an inlet connection mounted in a fixed position on one frame side, said frame side and through said reel flange fluidly communicated to an outlet adapter on a second side of said flange;

a pair of wheels journaled to each said rear leg; and a handle having a first leg pivotally connected to said top surface of one said frame side and a second leg pivotally connected to said top surface of said second frame side, said handle storable juxtaposition to said frame side;

a foldable storage tray which is hingably attached to a bracket mounted to said handle sides, said tray further including a railing for slidably attaching a hose guide, said hose guide including an alignment bracket for encompassing said railing, a guide handle for grasping said guide, and an aperture for receiving the hose;

wherein said handle folds over said single piece support frame and said reel flange rotates to an angular position allowing a fully assembled hose storage apparatus to be stacked in a nesting arrangement over a similar assembled hose storage apparatus.

3. The hose storage apparatus according to claim 2 wherein each said cross-braces are further defined as two semi-circular brackets forming identical reel surface halves.

4. The hose storage apparatus according to claim 3 wherein each said reel surface includes at least one hose relief cavity comprising an inward slope depending from a first edge of said reel surface having a first depth set a first distance from an end of said reel surface to a second edge of said reel surface at a depth less than said first depth and set a second distance from said first end of said reel surface.

5. The hose storage apparatus according to claim 3 wherein each said reel surface includes at least one aperture of sufficient size to permit a human hand to reach through whereby said aperture allows an operator to couple a free end of a flexible hose to said hose connector.

6. The hose reel storage apparatus according to claim 2 wherein said handle is constructed of moldable plastic material and pivotally attached to said frame being positionable from an upright position to a lowered position to facilitate storage of the storage apparatus, said handle having a locking mechanism secured to each said arm of said handle for releasably securing said handle to said top portion of each said frame side.

7. The hose storage apparatus according to claim 6 wherein said locking mechanism is concealed within an enlarged portion of each said arm of said handle, said locking mechanism engagable with said top portion of each said frame side.

8. The hose storage apparatus according to claim 2 wherein said hose connector includes: a hose male connector being adaptable for connection to flexible hose available for winding about the spool, a hose female adapter being adaptable for connection to an inlet hose, and a coupling sleeve, said hose male connector having at least one O-ring contacting the hose female adapter to form a seal therebetween.

9. The hose storage apparatus according to claim 8 wherein said coupling sleeve is further defined as a plurality of inwardly biased tabs available for locking said hose male connector to said hose female connector, said tabs operatively associated with said hose female connector.

10. The hose storage apparatus according to claim 9 wherein said tabs are removed from a biased position with said hose female connector by pulling said coupling sleeve away from said female hose connector.

11. The hose storage apparatus according to claim 2 wherein said crank includes said handle that is constructed of moldable plastic material and securable to said hub, said crank including a handle pivotally attached to a shank of said crank being positionable from a perpendicular position for rotation to a raised position to facilitate storage of the storage apparatus, said handle frictionally engaging said shank for holding in the raised position.

12. The hose storage apparatus according to claim 11 wherein said crank can be placed in either hub allowing said crank to operate in a left hand or right hand position.

13. The hose storage apparatus according to claim 2 wherein said frame is constructed from a single piece of plastic further defining each said frame side by inverted V-shaped structures having a flattened top portion and split legs depending therefrom, said frame positionable on another frame allowing a nesting arrangement.

14. The hose storage apparatus according to claim 2 wherein said handle includes a cross brace providing a slot for maintaining a free end of a flexible hose in an upright position.

15. The hose storage apparatus according to claim 2 wherein said first and second oblong shaped reel flange includes a means for coupling two of said cross-braces in a fixed diametrically opposed position.

16. The hose storage apparatus according to claim 15 wherein each said oblong shaped reel flange is further defined as having a length of approximately 15 inches and a width of approximately 7.5 inches.

17. The hose storage apparatus according to claim 2 wherein each said oblong shaped reel flange hub includes four equal spaced indentations operatively associated with spaced apart engagement tabs of said crank.

18. The hose storage apparatus according to claim 2 wherein each said oblong shaped reel flange hub includes four equal spaced indentations operatively associated with spaced apart engagement tabs of said hose coupler.

19. The hose storage apparatus according to claim 2 wherein each said oblong shaped reel flange hub includes a flat front surface proximal to a centrally disposed aperture and a ribbed back surface providing support for an elongated extension of said aperture.

20. A stackable hose storage apparatus for windably holding an elongated flexible garden hose comprising:

a single piece support frame having two inverted V-shaped frame sides, each said frame side having a top surface and split legs depending therefrom forming a front leg and a rear leg, said frame sides formed integral with a front cross bar supporting said front legs and a rear cross bar supporting said rear legs, each said frame side having a hub bearing surface disposed between said top surface and said split legs, said frame also including a foot rest to assist in holding the device in place during operation;

a spool disposed between said frame sides, said spool having a plurality of cross-braces defining a reel surface for receipt of a flexible hose, said reel surface coupled between a first and second oblong shaped reel flange having a length and a width with said length greater than said width, each said reel flange having a centrally disposed hub operatively associated with each said frame side;

a hose connector comprising a hose male connector being adaptable for connection to flexible hose available for winding about said spool, a hose female connector being adaptable for connection to an inlet hose, and a coupling sleeve, said hose male connector having at least one O-ring contacting said hose female connector to form a seal therebetween, said hose connector releasably insertable through one of said hubs providing an inlet connection mounted in a fixed position on one side of a said reel flange fluidly communicated to an outlet adapter on a second side of said flange;

a crank releasably insertable through one of said hubs providing a direct coupling to said spool allowing rotation thereof, said crank including a crank handle pivotally attached to said crank being positionable from a perpendicular position for hand operation to a raised position to facilitate storage;

a pair of wheels journaled to each rear leg;

a handle having a first leg pivotally connected to said top surface of one said frame side and a second leg pivotally connected to said top surface of said second frame side, said handle storable juxtaposition to said frame side; and a foldable storage tray which is hingably attached to a bracket mounted to said handle sides, said tray further including a railing for slidably attaching a hose guide, said hose guide including an alignment bracket for encompassing said railing, a guide handle for grasping said guide, and an aperture for receiving the hose.

21. The hose storage apparatus according to claim 20 wherein said coupling sleeve is further defined as a plurality of inwardly biased tabs available for locking said hose male connector to said hose female connector, said tabs operatively associated with said hose female connector.

22. The hose storage apparatus according to claim 21 wherein said tabs are removed from a biased position with said hose female connector by pulling said coupling sleeve away from said female hose connector.

23. The hose storage apparatus according to claim 20 wherein said handle of said crank maintained in a raised position by frictional engagement.

24. The hose storage apparatus according to claim 20 wherein said cross brace defines a plurality of cavities of sufficient angular shape so as to allow a flexible hose to couple to said female coupling at an angle providing a gradual slope for relief of hose stress upon coupling of the flexible hose to a said male hose connector.

25. The hose storage apparatus according to claim 24 wherein said cavities allow directional placement of a flexible hose whereby the flexible hose can be wound about said spool of the apparatus in a clockwise or counter clockwise direction.

* * * * *